US005501207A

United States Patent [19]

Black

[11] Patent Number: 5,501,207

[45] Date of Patent: Mar. 26, 1996

[54] ARM BRACED SLINGSHOT

[76] Inventor: Sidney L. Black, 1823 Sherry La., Edmond, Okla. 73003

[21] Appl. No.: 363,084

[22] Filed: Dec. 23, 1994

[51] Int. Cl.[6] ..... F41B 3/02

[52] U.S. Cl. ..... 124/20.1

[58] Field of Search ..... 124/20.1, 20.3, 124/17

[56] References Cited

U.S. PATENT DOCUMENTS

| | | | |
|---|---|---|---|
| 2,807,254 | 9/1957 | Stribling | 124/20.1 |
| 3,749,075 | 7/1973 | Saunders | 124/20.1 |
| 3,812,834 | 5/1974 | Saunders | 124/20.1 |
| 3,865,094 | 2/1975 | Sweeney | 124/20.1 |
| 3,875,923 | 4/1975 | Horel | 124/20.1 |
| 4,265,212 | 5/1981 | Wolf | 124/20.1 |
| 4,877,007 | 10/1989 | Olson | 124/20.3 X |
| 5,072,715 | 12/1991 | Barr | 124/20.1 |
| 5,230,323 | 7/1993 | Saunders et al. | 124/20.1 |

*Primary Examiner*—John A. Ricci
*Attorney, Agent, or Firm*—Robert K. Rhea

[57] ABSTRACT

An improved target practice and hunting slingshot is formed by a U-shaped member having elongated legs adapted to extend along opposite sides of a forearm with the bight portion disposed forwardly of a user's hand when gripping a handle transversely extending between the legs. Inverted L-shaped posts surmounted on the respective forward end portion of each leg adjacent the bight portion have their foot portion projecting generally rearwardly in parallel relation and angularly disposed relative to the longitudinal axis of the respective frame leg for better sighting alignment of the missile pocket of a sling connected with the post foot portions and transferring the strain of stretching the sling resilient members to the forearm of a user.

10 Claims, 2 Drawing Sheets

ARM BRACED SLINGSHOT

BACKGROUND OF THE INVENTION

1. Field of the Invention

This invention relates to slingshots and more particularly to a hand and wrist strain releasing slingshot.

Slingshots have been in use for many years as toys, recreation, and for hunting.

Basically, a slingshot comprises a handle portion and a pair of arms diverging upwardly from the handle to which a pair of resilient strands are connected at one end and are provided at their other ends with a missile holding pocket or socket.

The sling frame can be of crude construction, for example, a forked tree branch. Alternatively, the frame can be more sophisticated in structure or fashioned for increased accuracy and less strain or tension on the arm and hand of a user as will presently be evident.

2. Description of the Prior Art

U.S. Pat. No. 2,807,254 issued Sep. 24, 1957 to Stribling for SLING SHOT discloses a rod-like U-shaped member in which the bight portion of the U-shape overlies the forearm of the user and the legs of the U-shaped member are transversely joined by a hand grip member. Forwardly projecting hook arms are secured to the legs of the U-shaped member and support one end of a pair of elastic tubes joined at their other ends to a missile holding pocket for launching a missile in response to stretching and releasing the resilient members.

U.S. Pat. No. 3,865,094 issued Feb. 11, 1975 to Sweeney for ARM BRACED AND STABILIZED SLINGSHOT discloses an upright handle and a fork for attachment to one end of a pair of elastic bands having a missile pocket secured to their other ends. A single rod extends from the depending end of the upright handle and extends along the lower side of the forearm of a user and is provided with an arm strap which secures the rod to the forearm for transferring slingshot missile pulling forces from the wrist of the operator to his upper forearm.

U.S. Pat. No. 4,265,212 issued May 5, 1981 to Wolf for HAND CATAPULT and U.S. Pat. No. 5,230,323 issued Jul. 27, 1993 to Saunders et al for SLINGSHOT CONSTRUCTION are believed to represent the further state-of-the-art. Each of these patents discloses a contoured handle member having upstanding diverging arms forming a fork to which ends of a pair of resilient members are attached having a pouch secured to their other ends for launching a missile. Each of the patents further include an arm or wrist overlying rearward extension in which resilient force of the elastic members is transferred to the upper surface of the user's forearm.

The present invention is believed distinctive over all of the above named patents by its parallel leg U-shaped frame construction and manner of attaching the frame legs to the forearm of a user to provide an easily adjustable construction for comfort of the user and accuracy of missile shot by the angular position of the slingshot forks relative to the frame as will be presently apparent from the following description.

SUMMARY OF THE INVENTION

In one embodiment a U-shaped frame includes a bight portion disposed forwardly of a user's hand gripping a handle, palm down, interconnecting frame rod-like legs adjacent its bight portion. The legs are elongated and extend toward the user's elbow on either side of his forearm. A pair of fabric saddle straps each having a loop at its respective end surrounding the respective leg of the U-shaped frame in front-to-rearward spaced relation overlies the forearm of a user and is secured thereto by an elongated strap provided with self-adhesive material when disposed in end overlapping position.

A pair of inverted L-shaped posts are surmounted on the respective frame leg adjacent the bight portion with the post foot portion projecting rearwardly in acute angular relation with respect to the longitudinal axes of the frame legs.

A sling is secured to the rearward end of the post foot portions. A counterweight is secured to the medial portion of the frame bight portion and projects forwardly therefrom.

In a second embodiment, the posts are connected with the respective frame legs in a manner which permits selectively positioning the foot portion of the posts in desired acute angular relation with respect to the longitudinal axes of the frame legs. Further, the second embodiment includes a strap member connected with one end of the handle and secured at its other end to the adjacent frame leg in rearward spaced relation with respect to the other end of the handle to provide a comfortable stress releaving grip for the user's hand when grasping the handle.

The principal objects of this invention are: to provide a balanced unit formed by parallel frame rods joined at one end by a U-shaped bight portion; a hand grip adjacent the bight portion; arm saddle straps securing the rods to the user's forearm which counters the stress or pull of a tubular sling and provides stability for true and accurate shooting in which sling attached members are disposed at a predetermined angle relative to the parallel frame rods and complement the tubular sling for obtaining full power and velocity from the sling stretch; in which the hand grip and hand and arm straps are adjustable for different individuals; which provides a uniform stretch of the tubular sling; and, which is rugged in construction and may be easily disassembled for packing or storage.

DESCRIPTION OF THE PREFERRED EMBODIMENTS

Figure 1:
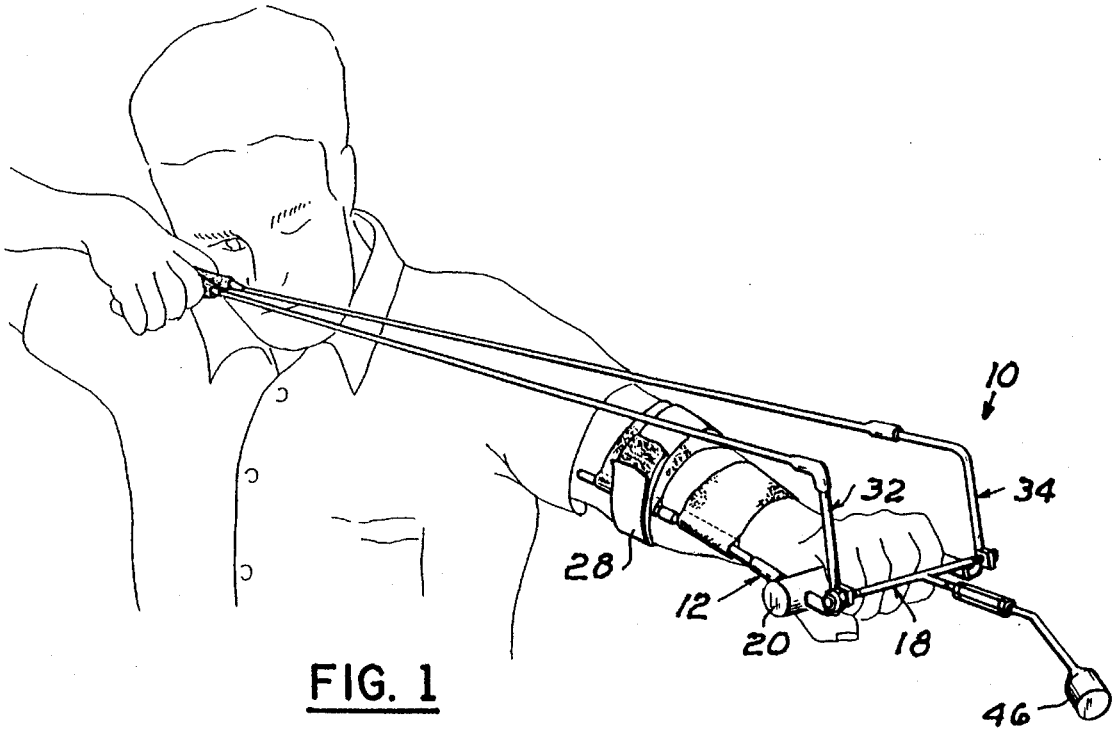
FIG. 1 is a perspective view illustrating one embodiment in operative position.
Figure 2:
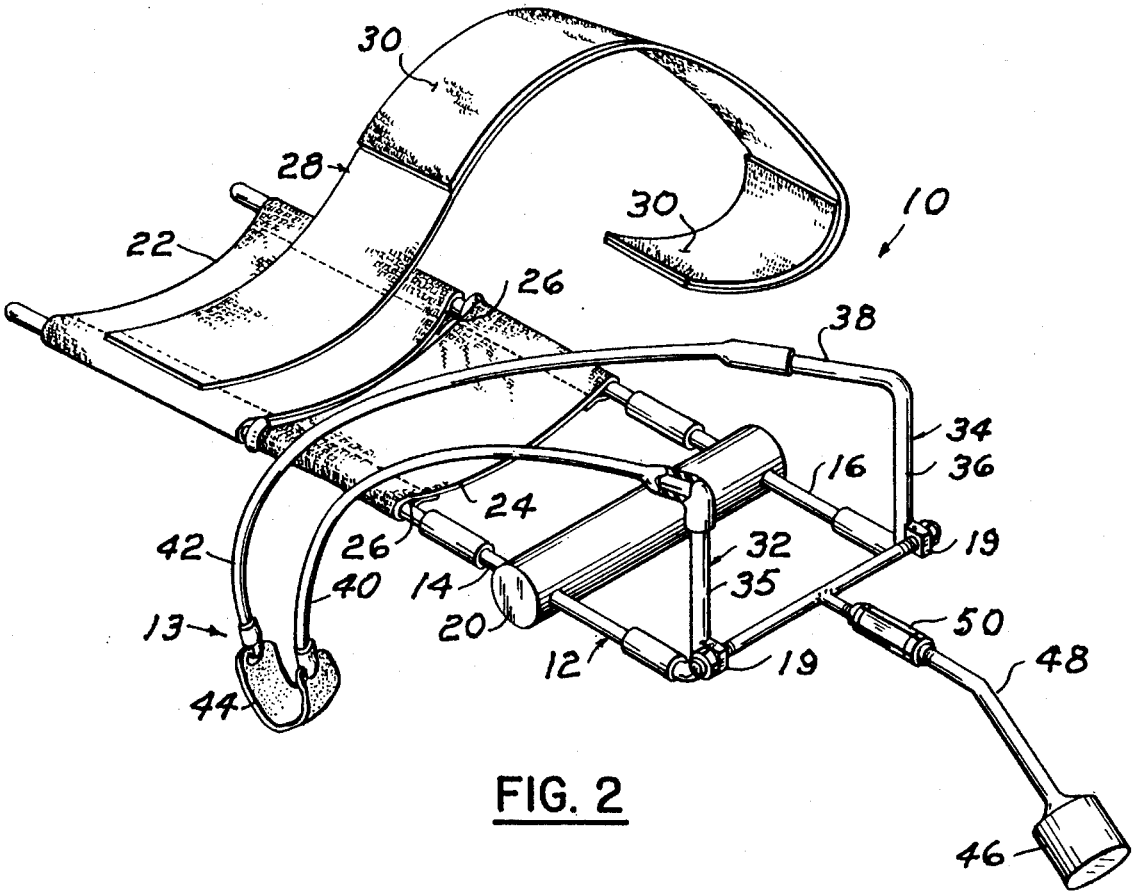
FIG. 2 is a perspective view to a larger scale of the slingshot and its components, per se.

Like characters of reference designate like parts in those figures of the drawings in which they occur.

The reference numeral 10 indicates one embodiment of a slingshot comprising a U-shaped frame 12 and sling 13, the frame having elongated rod-like substantially parallel spaced-apart legs 14 and 16 interconnected at their forward ends by a bight portion 18. In the example shown, the bight portion 18 is similarly rod-like and provided with right and left handle threads cooperatively received by nuts 19 rigidly secured to the respective frame leg for the purpose presently explained. Rearwardly of the bight portion 18 a cylindrical handle 20 extends between and surrounds an intermediate portion of the respective leg, at its respective end portions, to be grasped by a user's hand in palm down position.

At least one saddle strap, preferably two indicated at 22 and 24, extend transversely between the frame legs in front to rearward spaced relation. Each of the saddle straps 22 and 24 are provided with loops 26 at their respective ends for surrounding intermediate portions of the respective frame legs and overlie the upper portion of a user's forwardly extended forearm to support the frame legs on respective sides of the forearm when in use.

Figure 3:
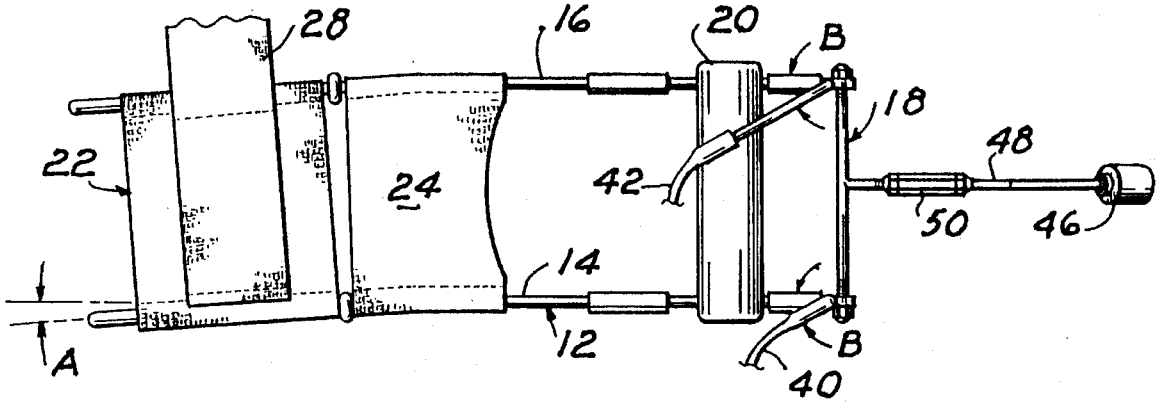
FIG. 3 is a fragmentary top view of the slingshot illustrating the angular position of parallel rods relative to each other; and, FIG. 4 is a view similar to FIG. 2 illustrating another embodiment of the slingshot.

The frame legs 14 and 16 are bent laterally medially their ends in parallel relation at an acute angle A (FIG. 3), for example 3° to 5° to conform to the user's forearm forwardly of the elbow as viewed in FIG. 1.

An elongated strap 28 having self-adhesive fabric material 30, such as VELCRO, secured to its opposite surfaces, in selected positions, is wrapped around the frame legs and user's forearm, over the rearward strap 22, to prevent vertical movement of the rearward end portions of the frame legs relative to a user's forearm when grasping the handle 20 and projecting a missile.

Figure 4:
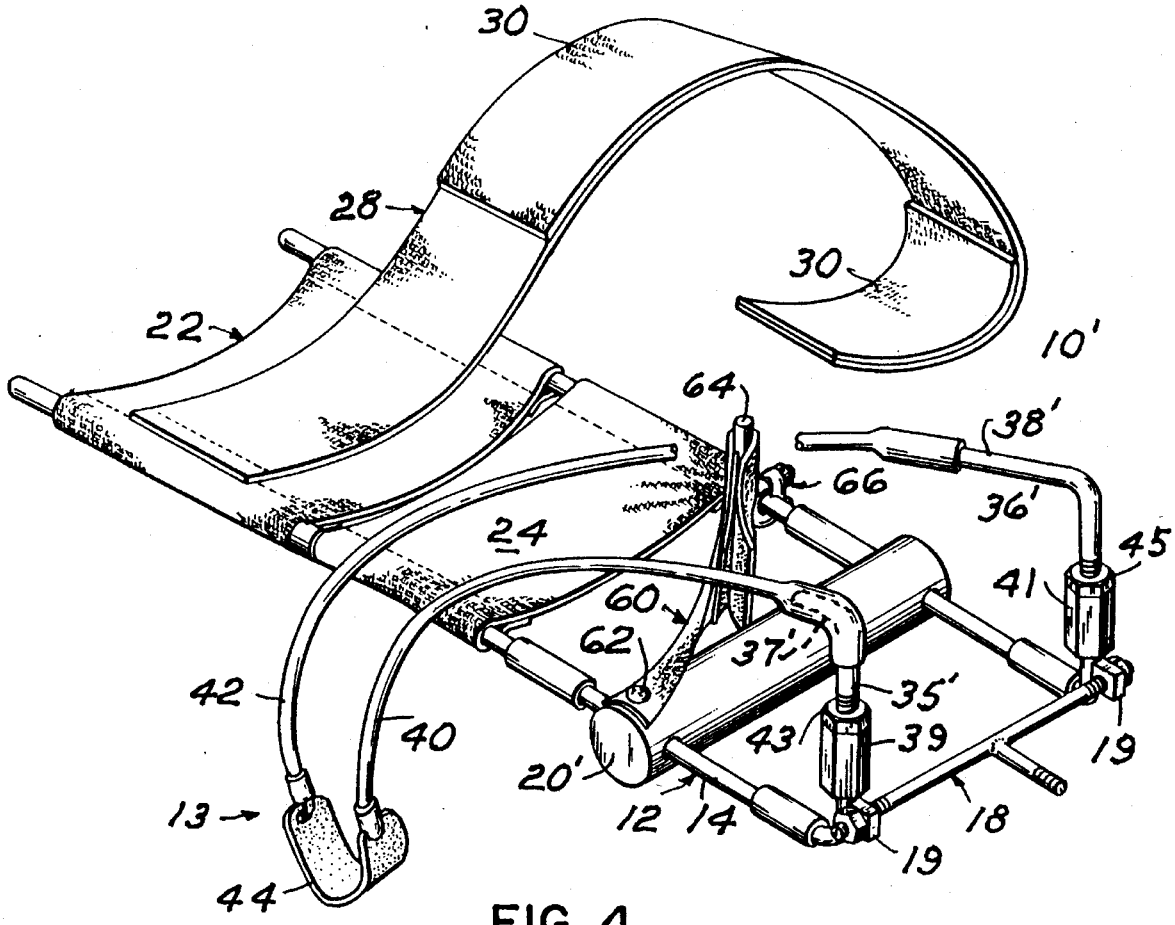

In the examples shown, the forward end portions of the frame legs 14 and 16 are turned upwardly at the position of the bight portion 18 to form a pair of inverted L-shaped posts 32 and 34 substantially normal to the longitudinal axes of the legs 14 and 16. The posts each have an elongated standard portion 35 and 36. Obviously, the posts 32 and 34 may be separate units and respectively secured to the frame legs 14 and 16 in upstanding parallel relation adjacent the bight portion 18 (FIG. 4).

The pair of posts 32 and 34 each have a foot portion 37 and 38, respectively, on the respective standard 35 and 36. The foot portions 37 and 38 project rearwardly in substantially parallel relation at an angle B, for example 30° (FIG. 3) with respect to the longitudinal axis of the respective frame leg.

The foot portion 38 is formed longer than the foot portion 37 so that the terminal ends of the foot portions terminate in a plane extending transversely of the foot portions and normal to the longitudinal axes of the foot portions for connection with equals lengths sling strands as will now be described.

The sling 13 comprises a pair of equal length elongated flexible elastic tubular members 40 and 42 respectively connected at one end portion with the respective terminal end portion of the respective post foot portion 37 and 38. The other ends of the flexible strands or members 40 and 42 are respectfully connected with one end of a missile pocket 44 which nests a missile, not shown, when the pocket is gripped by the fingers of a user.

A counterweight 46 supported by one end of a forward and downwardly projecting rod-like member 48, is secured to the medial portion of the bight portion 18 by a threaded coupling 50.

Referring also to FIG. 4, an alternative embodiment of the slingshot is indicated at 10' which is substantially identical with the embodiment 10 as here-in-after described and wherein like parts bear identical reference numerals.

One end portion of the hand grip 20' is secured to one end portion of a strap-like hand grip portion 60, as by a screw 62. The other end portion of the palm grip strap 60 is secured to an upstanding rod-like prong 64 in wrap-around relation. The prong 64 being secured at its depending end portion to the frame leg 16 rearwardly of the hand grip 20', as by a clamp 66.

The purpose of the prong strap 60 is to ease the tension or strain of a hand gripping the handle 20 or 20' during prolonged use of the slingshot. In this embodiment, the post standards 35' and 36' are connected with the respective frame leg 14 and 16 by upstanding internally threaded sleeves 39 and 41 rigidly secured to the respective frame leg 14 and 16.

Lock nuts 43 and 45 surrounding the respective post standard 35' and 36' secure the respective standard and position its respective foot portion 37' and 38' in parallel selected angular relation with respect to the longitudinal axes of the frame legs.

Operation

Operation, seems obvious, to those skilled in the use of slingshots from the above description, but briefly stated, with the slingshot 10 or 10' assembled as disclosed hereinabove, a user places the slingshot on his left forearm, in the example shown, and grasps the hand grip 20, palm down, with the frame legs 14 and 16 disposed on opposing sides of his forearm and the saddle straps 22 and 24 overlying the upper surface of his forearm and temporarily supporting the U-shaped frame.

The free end of the hold-down band 28 is wrapped around his forearm and the saddle strap 22 and secured by the self adhesive material. The user then places a missile, not shown, in the sling pocket 44 and draws the pocket rearwardly, stretching the sling members 40 and 42 and aims the missile at a target, not shown, and releases the missile.

Obviously the invention is susceptible to changes or alterations without defeating its practicability. Therefore, I do not wish to be confined to the preferred embodiment shown in the drawings and described herein.

I claim:

1. A slingshot, comprising;

a U-shaped frame having forward and rearward end portions and having a pair of leg members adapted to respectively extend along opposite sides of a forearm of a user and having a bight portion normally disposed forwardly of a hand of a user;

a saddle strap extending between and secured at its respective end portions to the respective leg of said pair of leg members opposite the bight portion for overlying an intermediate portion of a forearm and supporting said leg members adjacent opposite sides of the forearm;

a hand grip extending between and secured at its respective end portions to the respective leg of said pair of leg members adjacent the bight portion for grasping by the hand of a forearm with the wrist thereof level with the forearm and supporting the forward end portions of said pair of leg members substantially parallel with the forearm and wrist;

a pair of inverted L-shaped posts each having a standard portion respectively surmounted on the respective leg of said pair of leg members adjacent respective ends of the bight portion, each standard of said pair of posts having a foot portion of unequal length with respect to the length of the other foot portion, said foot portions projecting generally rearwardly in parallel relation, and in acute angular relation with respect to the longitudinal axis of the respective leg of said leg members; and, a sling including a missile pocket and equal length resilient tubular members respectively secured, at one end portion, with the end portion of respective foot portion opposite the standard of said pair of posts.

2. The slingshot according to claim 1 in which the rearward end portion of each leg of said pair of legs opposite the bight portion is turned laterally at an acute angle with respect to the longitudinal axis of its forward end portion in a cooperation with the other leg of said pair of legs for cooperatively disposing the rearward end portion of the respective leg of said pair of leg members adjacent opposite sides of a forearm adjacent an elbow.

3. The slingshot according to claim 2 and further including:

a hold-down band having self adhesive fabric on opposite surfaces secured at one end portion to said saddle strap for extending around a forearm for precluding vertical movement of said legs relative to a forearm about the longitudinal axis of said handle.

4. The slingshot according to claim 3 and further including:

a counter weight secured to the medial portion of said bight portion in forwardly projecting relation,

5. The slingshot according to claim 4 and further including:

coupling means including a threaded sleeve interposed between the respective standard of said pair of posts for positioning the respective foot portion of said pair of posts on a selected acute angle with respect to the longitudinal axis of the respective leg of said pair of legs.

6. The slingshot according to claim 5 in which said bight portion is threadedly connected at its respective end portions with the respective leg of said pair of leg members for expanding or contracting the spacing between the adjacent end portions of said pair of legs.

7. The slingshot according to claim 1 and further including:

a hold-down band having self adhesive fabric on opposing surfaces secured to said saddle strap for extending around a forearm for precluding vertical movement of said legs of said pair of legs relative to a forearm about the longitudinal axis of said handle.

8. The slingshot according to claim 1 and further including:

a counter weight secured to the medial portion of said bight portion in forwardly projecting relation.

9. The slingshot according to claim 1 and further including:

coupling means including a threaded sleeve interposed between the respective standard of said pair of posts for positioning the respective foot portion of said pair of posts on a selected acute angle with respect to the longitudinal axis of the respective leg of said pair of legs.

10. The slingshot according to claim 1 in which said bight portion is threadedly connected at its respective end portions with the respective leg of said pair of leg members for expanding or contracting the spacing between the adjacent end portions of said pair of legs.

* * * * *